US010907638B2

(12) United States Patent
Wilds et al.

(10) Patent No.: US 10,907,638 B2
(45) Date of Patent: Feb. 2, 2021

(54) MULTI-OUTLET UTILITY PUMP

(71) Applicant: Wayne/Scott Fetzer Company, Westlake, OH (US)

(72) Inventors: Joshua Michael Wilds, Harrison, OH (US); Michael Steven Garcia, Harrison, OH (US); Buford A. Cooper, Sunman, IN (US)

(73) Assignee: Wayne/Scott Fetzer Company, Westlake, OH (US)

( * ) Notice: Subject to any disclaimer, the term of this patent is extended or adjusted under 35 U.S.C. 154(b) by 376 days.

(21) Appl. No.: 15/218,317

(22) Filed: Jul. 25, 2016

(65) Prior Publication Data

US 2017/0030371 A1 Feb. 2, 2017

Related U.S. Application Data

(60) Provisional application No. 62/197,179, filed on Jul. 27, 2015.

(51) Int. Cl.

| | |
|---|---|
| ***F04D 13/06*** | (2006.01) |
| ***F04B 39/12*** | (2006.01) |
| ***F04D 29/60*** | (2006.01) |
| ***F04D 29/42*** | (2006.01) |
| ***F04D 29/70*** | (2006.01) |

(52) U.S. Cl.

CPC ..... *F04D 13/068* (2013.01); *F04B 39/123* (2013.01); *F04D 29/4293* (2013.01); *F04D 29/605* (2013.01); *F04D 29/708* (2013.01)

(58) Field of Classification Search

CPC .... F04D 13/068; F04D 29/605; F04D 29/708; F04D 29/4293; F04D 15/0016; F04B 39/123

USPC ..... 417/410.1, 332

See application file for complete search history.

(56) References Cited

U.S. PATENT DOCUMENTS

| | | | | |
|---|---|---|---|---|
| 2,333,243 | A * | 11/1943 | Glab | F16L 37/113 220/293 |
| 2,553,066 | A | 5/1951 | Southern | |
| 2,863,525 | A | 12/1958 | Lucian | |
| 3,400,732 | A * | 9/1968 | Larrabee | F16L 41/03 137/899 |
| 3,667,870 | A | 6/1972 | Yoshida | |
| 3,684,096 | A | 8/1972 | Kretchman | |

(Continued)

FOREIGN PATENT DOCUMENTS

| | | |
|---|---|---|
| CN | 203548187 | 4/2014 |
| EP | 1178212 | 2/2002 |

(Continued)

OTHER PUBLICATIONS

Wayne/Scott Fetzer Company, Operating Instructions and Replacement Parts List, Submersible Utility Pumps VIP Series, that discloses a pump that was on sale or publicly disclosed more than 1 year before the filing of the instant application, 2011, 12 pp.

(Continued)

*Primary Examiner* — Charles G Freay
*Assistant Examiner* — Lilya Pekarskaya
(74) *Attorney, Agent, or Firm* — Fitch, Even, Tabin & Flannery LLP

(57) ABSTRACT

A multi-outlet fluid pump includes a housing, a motorized pump, an electrical power supply, a fluid inlet, and two separate discharge outlets.

20 Claims, 19 Drawing Sheets

(56) References Cited

U.S. PATENT DOCUMENTS

| | | | | |
|---|---|---|---|---|
| 3,822,967 | A | 7/1974 | Cade | |
| 3,936,240 | A | 2/1976 | Dochterman | |
| 4,482,300 | A | 11/1984 | Brown | |
| 4,820,131 | A | 4/1989 | Johnson | |
| 4,961,018 | A | 10/1990 | Akhter | |
| 5,055,000 | A | 10/1991 | Akhter | |
| 5,131,821 | A | 7/1992 | Marioni | |
| 5,145,322 | A | 9/1992 | Senior, Jr. | |
| 5,145,337 | A | 9/1992 | Kirkland | |
| 5,181,841 | A | 1/1993 | Kirkland | |
| 5,205,725 | A | 4/1993 | Pattison | |
| 5,494,414 | A | 2/1996 | Steinhart | |
| 5,525,039 | A | 6/1996 | Sieghartner | |
| 5,599,164 | A | 2/1997 | Murray | |
| D394,067 | S | 5/1998 | Kon | |
| 5,819,848 | A | 10/1998 | Rasmuson | |
| 5,833,437 | A | 11/1998 | Kurth | |
| 6,049,666 | A | 4/2000 | Bennett | |
| 6,059,542 | A * | 5/2000 | Chou | F04B 39/123 417/360 |
| 6,149,390 | A | 11/2000 | Fisher | |
| 6,375,430 | B1 | 4/2002 | Eckert | |
| 6,390,780 | B1 * | 5/2002 | Batchelder | F04D 15/0236 417/17 |
| 6,423,218 | B1 * | 7/2002 | Lindermeir | A01K 63/047 210/170.09 |
| 6,443,715 | B1 | 9/2002 | Mayleben | |
| 6,464,531 | B2 | 10/2002 | Eckert | |
| D466,527 | S | 12/2002 | Graber | |
| 6,530,758 | B1 * | 3/2003 | Ritter | F04D 15/0016 417/423.14 |
| 6,575,714 | B2 | 6/2003 | Pace | |
| 6,676,382 | B2 | 1/2004 | Leighton | |
| 7,153,418 | B2 | 12/2006 | Mauro, Sr. | |
| 7,264,449 | B1 | 9/2007 | Harned | |
| D589,060 | S | 3/2009 | Metcalfe | |
| 7,544,041 | B2 | 6/2009 | Mayleben | |
| D602,501 | S | 10/2009 | Ton | |
| 7,597,732 | B2 | 10/2009 | Yokota | |
| D611,504 | S | 3/2010 | Ton | |
| D667,466 | S | 9/2012 | Moormann | |
| 8,297,952 | B2 | 10/2012 | Wu | |
| 8,380,355 | B2 | 2/2013 | Mayleben | |
| 8,529,228 | B1 | 9/2013 | Thompson | |
| D691,638 | S | 10/2013 | Alexander | |
| D698,368 | S | 1/2014 | Le | |
| 8,636,898 | B2 | 1/2014 | Perez | |
| D706,834 | S | 6/2014 | Haslock | |
| D707,718 | S | 6/2014 | Gomez | |
| 8,794,936 | B2 * | 8/2014 | Tokuo | F02M 37/0047 417/442 |
| D738,402 | S | 9/2015 | Nelson | |
| D739,919 | S | 9/2015 | Alexander | |
| D744,003 | S | 11/2015 | Ton | |
| 9,399,976 | B2 * | 7/2016 | Ramamurthy | F04B 1/0404 |
| 9,605,688 | B2 | 3/2017 | Perez | |
| D788,932 | S | 6/2017 | Ton | |
| 9,714,665 | B2 | 7/2017 | Saccoccio | |
| 9,810,241 | B2 | 11/2017 | Gell, III | |
| D817,363 | S | 5/2018 | Alexander | |
| 9,964,111 | B2 | 5/2018 | Yano | |
| D823,345 | S | 7/2018 | Cooper | |
| D823,898 | S | 7/2018 | Alexander | |
| D836,677 | S | 12/2018 | Alexander | |
| D848,487 | S | 5/2019 | Van Opdorp | |
| D875,142 | S | 2/2020 | Wilds | |
| 1,076,058 | A1 | 9/2020 | Saccoccio | |
| 2003/0002996 | A1 | 1/2003 | Pace | |
| 2003/0091440 | A1 * | 5/2003 | Patel | F04B 39/121 417/12 |
| 2003/0161732 | A1 | 8/2003 | Kimberlin | |
| 2005/0201858 | A1 * | 9/2005 | Wang | F04D 29/4293 415/126 |
| 2005/0231899 | A1 | 10/2005 | Barnes | |
| 2006/0064954 | A1 | 3/2006 | Yokota | |
| 2006/0083630 | A1 | 4/2006 | Chen | |
| 2006/0275162 | A1 | 12/2006 | Mayleben | |
| 2008/0199326 | A1 | 8/2008 | Masoudipour | |
| 2011/0123357 | A1 | 5/2011 | Leone | |
| 2013/0214895 | A1 | 8/2013 | Ullermann | |
| 2014/0166109 | A1 * | 6/2014 | Takai | B60S 1/481 137/1 |
| 2014/0286747 | A1 * | 9/2014 | Fang | F04D 29/4293 415/1 |
| 2014/0341752 | A1 | 11/2014 | Gell, III | |
| 2015/0167673 | A1 * | 6/2015 | Saccoccio | F04D 29/426 415/1 |
| 2015/0308425 | A1 * | 10/2015 | Skotty | F04B 35/06 137/565.18 |
| 2016/0037987 | A1 * | 2/2016 | Caro | A47L 9/04 15/334 |
| 2017/0030371 | A1 | 2/2017 | Wilds | |
| 2019/0048875 | A1 | 2/2019 | Mayleben | |
| 2019/0154061 | A1 | 5/2019 | Gilliland | |
| 2019/0309757 | A1 | 10/2019 | Rejniak | |

FOREIGN PATENT DOCUMENTS

| | | | | |
|---|---|---|---|---|
| EP | 1241357 | | 9/2002 | |
| EP | 3058800 | A1 * | 8/2016 | A01C 23/045 |
| GB | 1320841 | | 6/1973 | |
| RU | 2489784 | | 7/2013 | |
| RU | 166537 | | 11/2016 | |
| WO | 0017521 | | 3/2000 | |
| WO | 2006137777 | | 12/2006 | |
| WO | 2011137425 | | 11/2011 | |
| WO | 2012037991 | | 3/2012 | |

OTHER PUBLICATIONS

Wayne/Scott Fetzer Company, Watering & System Installation Guide, Dewatering Pump TSC, that discloses a pump that was on sale or publicly disclosed more than 1 year before the filing of the instant application, 2016, 11 pp.

Blue Angel Pump Company, Blue Angel Catalog, 2018, 34 pp.

Blue Angel Pump Company, Blue Angel Catalog, Oct. 2015, 39 pp.

Wayne Water Systems, Wayne Catalog, Oct. 2014, 52 pp.

Patent Cooperation Treaty, International Searching Authority, Notification of Transmittal of the International Search Report and the Written Opinion of the International Searching Authority, or the Declaration issued in International Application No. PCT/US2018/046604, dated Nov. 29, 2018, 11 pp.

* cited by examiner

MULTI-OUTLET UTILITY PUMP

CROSS-REFERENCE TO RELATED APPLICATIONS

This application claims the benefit of U.S. provisional patent application No. 62/197,179, titled "Multi-Outlet Utility Pump," filed on Jul. 27, 2015, which is hereby incorporated by reference in its entirety.

FIELD OF TECHNOLOGY

The present disclosure generally describes fluid pumping devices. More specifically, the present disclosure describes electrically powered motorized pumps with multiple discharge ports.

BACKGROUND

Electric motor driven utility pumps can use various techniques to move water and other fluids from one location to another. Such pumps operate by drawing fluid into the main pump body and then discharging the fluid through an outlet. The outlet can be attached to a conduit, such as a standard garden hose, to deliver the discharged fluid to a separate location.

Utility pumps typically provide discharge outlets in one of two locations. More specifically, pumps typically employ either a top (axial) discharge outlet 502 as shown in FIGS. 5A-B, or a side (radial) discharge outlet 604, as shown in FIGS. 6A-B. Each of these different pumps having their own benefits and drawbacks. For example, pumps with top discharge outlets 500 typically occupy a smaller footprint and can fit into smaller locations, but tend to be less stable, and more prone to tipping over, especially when an attached hose is moved. On the other hand, the side discharge units 600 are more stable, but require a larger footprint due to the space needed for the hose attachment. Not surprisingly, top discharge units are typically desired for applications where the pump is being used to pump something up and out generally vertically from a lowered location, and side discharge units are desired for applications where the pump is being used to pump something out generally laterally from a location within the same proximate plane.

BRIEF DESCRIPTION OF THE DRAWINGS

Described herein are embodiments of systems, methods and apparatus for addressing these shortcomings.

This description includes drawings, wherein.

Figure 1A:
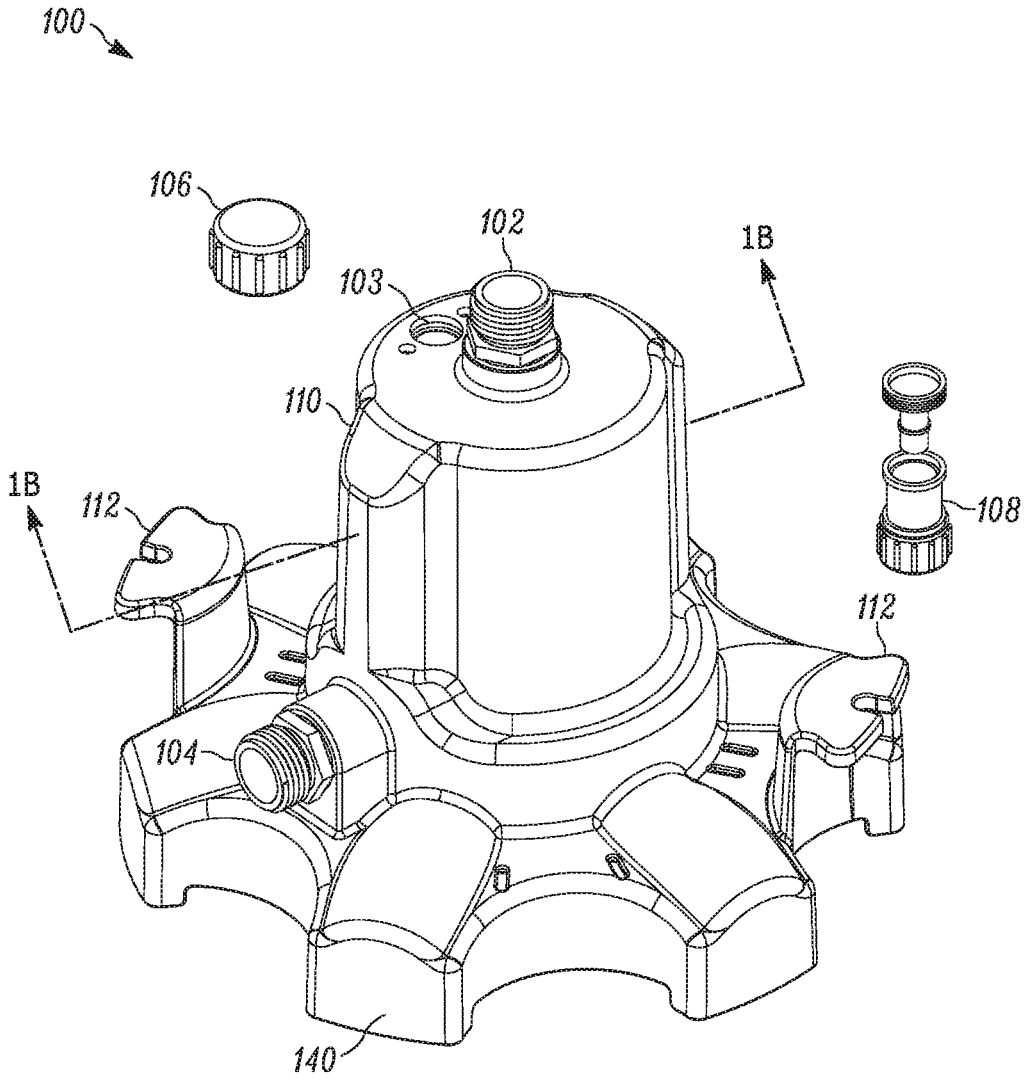
FIG. 1A is a perspective view as viewed from above of a multi-outlet fluid pump illustrating a cord-wrap mechanism and various types of sealing mechanisms.
Figure 1B:
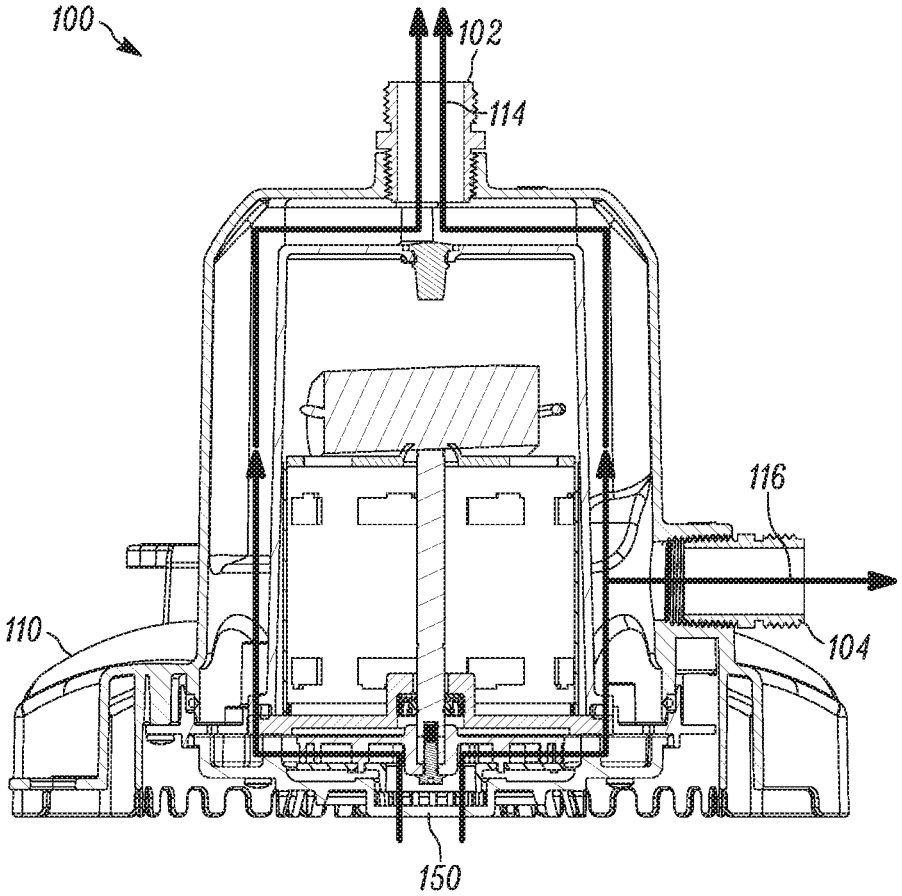
FIG. 1B is a cross-sectional view taken along lines 1B-1B in FIG. 1A of the multi-outlet fluid pump of FIG. 1A and shows various fluid flow paths within the pump.

Corresponding reference characters in the attached drawings indicate corresponding components throughout the several views of the drawings. In addition, elements in the figures are illustrated for simplicity and clarity and have not necessarily been drawn to scale. For example, the dimensions of some of the elements in the figures may be exaggerated relative to other elements to help to improve understanding of various embodiments. Also, common but well-understood elements that are useful or necessary in a commercially feasible embodiment are often not depicted or described in order to facilitate a less obstructed view of the illustrated elements and a more concise disclosure.

DETAILED DESCRIPTION

The present disclosure describes pumps with discharge outlets in multiple locations, for example, on both the top and the side. These pumps take advantage of the benefits, while minimizing the drawbacks, of pumps with only a single discharge outlet.

The present disclosure describes a pump that provides for either top or side discharge capabilities through the use of a unique pump housing design. A user can select the discharge location by attaching a conduit device (e.g., a garden hose) to one discharge outlet and sealing the other discharge outlet. For example, the user can install a threaded cap (which can be tethered to pump, for example, via a tether) onto the other discharge outlet.

Figure 5A:
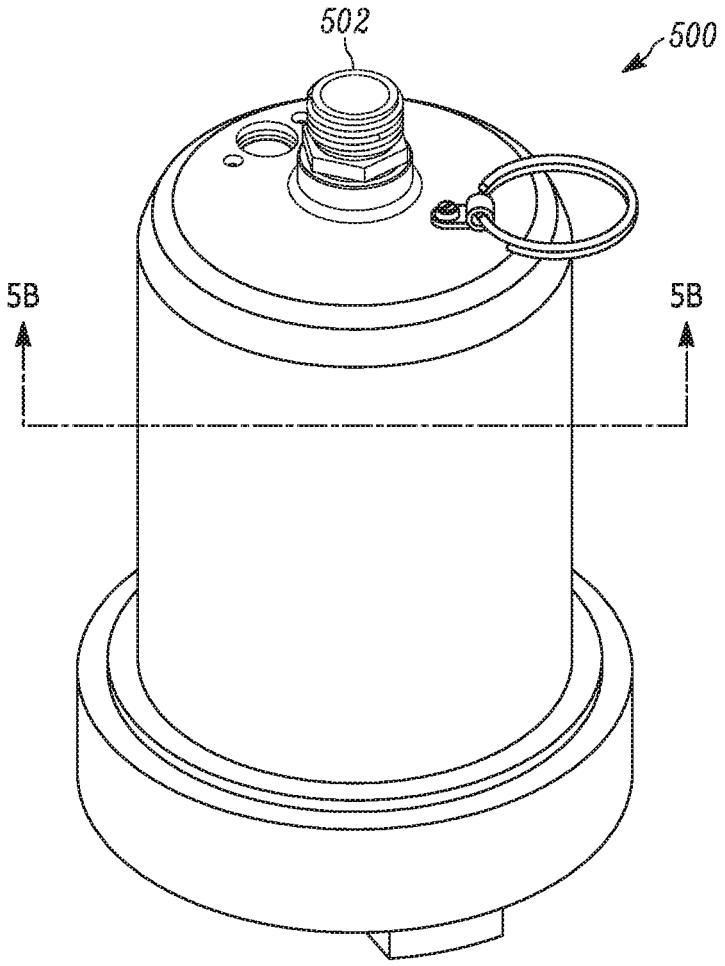
PRIOR ART FIGURE 5A
FIG. 5A is a perspective view of a conventional pump with a top discharge outlet.
Figure 5B:
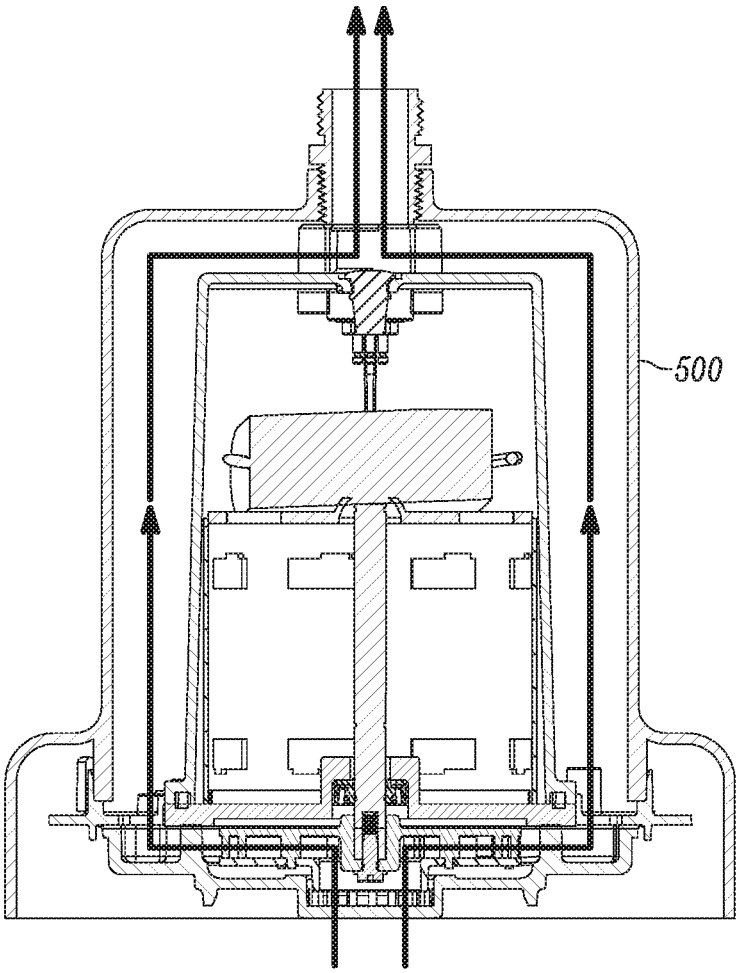
PRIOR ART FIGURE 5B
FIG. 5B is a cross-sectional view of the conventional pump of FIG. 5A taken along line 5B-5B, and shows the fluid flow path within the pump.
Figure 6A:
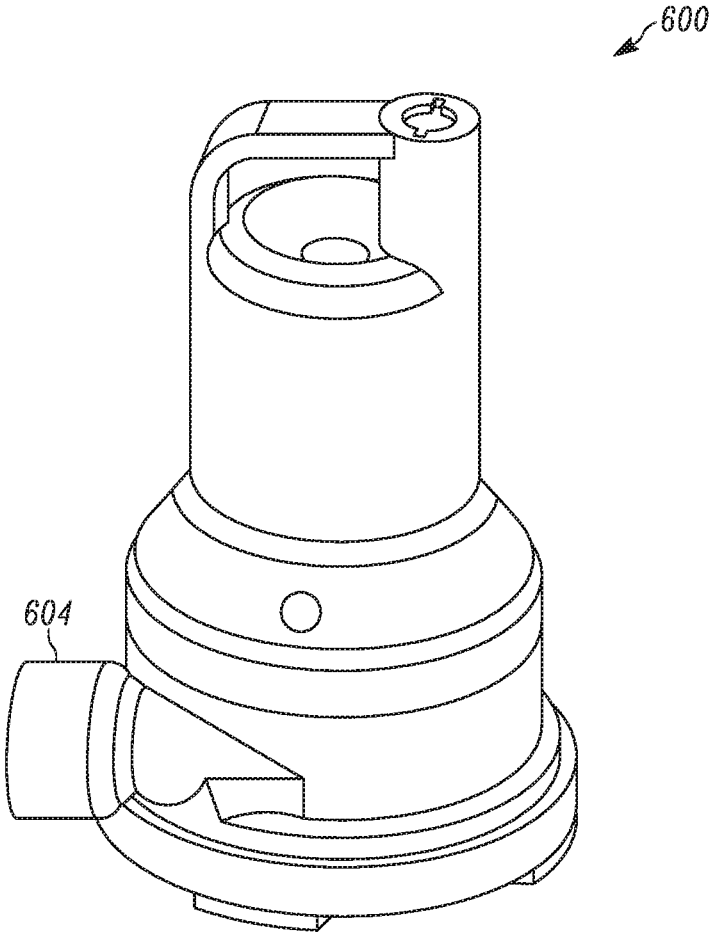
PRIOR ART FIGURE 6A
FIG. 6A is a perspective view of a conventional pump with a side discharge outlet.
Figure 6B:
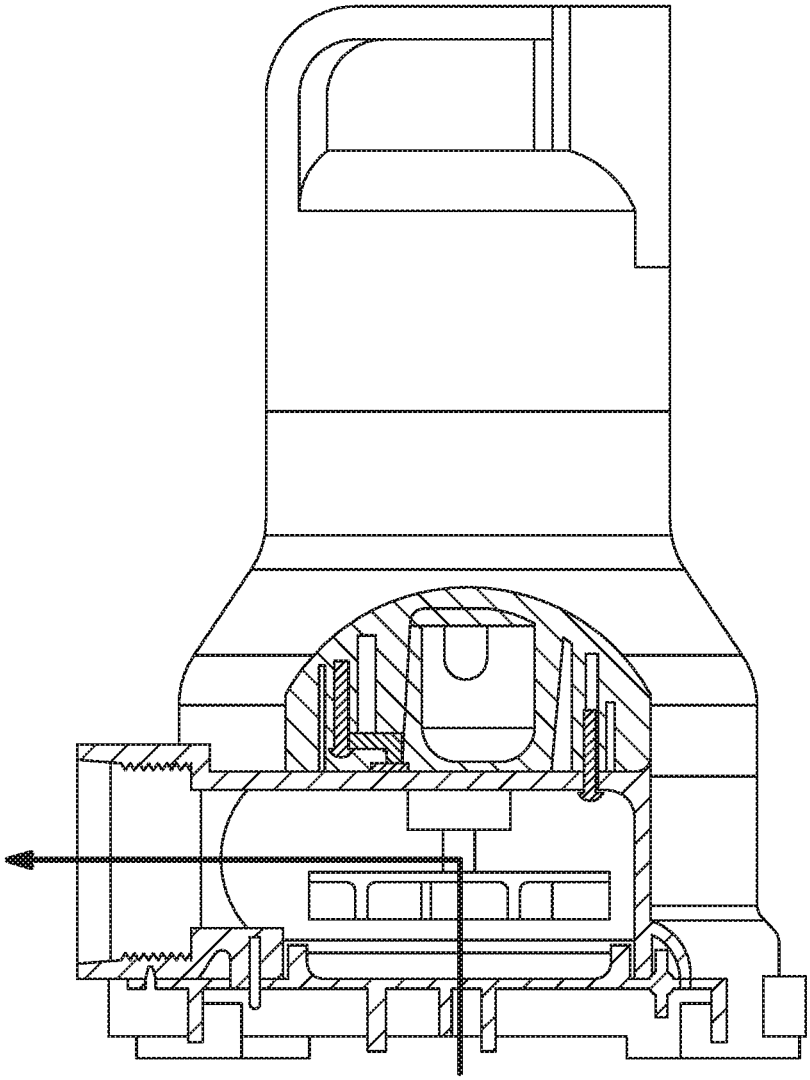
PRIOR ART FIGURE 6B
FIG. 6B is a side elevation view in partial cross-section of the conventional pump of FIG. 6A, and shows the fluid flow path within the pump.

Existing top discharge utility pumps 500 (see FIGS. 5A-B) utilize a second housing creating a water jacket, or a passageway to move water from the volute up the pump body and discharge from the top of the housing. Alternatively, side discharge pumps 600 (see FIGS. 6A-B) do not use a water jacket but rather discharge the water radially near the impeller centerline.

The presently described multi-outlet pump 100 combines both of these features into one unique housing 110 that allows for user changeable discharge depending on the application.

Certain embodiments also employ a design that filters debris from the pump. The proposed design reduces clogging during operation by way of multiple sets of progressively reduced openings to filter debris from large too small. This feature also allows for easy, tool-less cleaning of collected debris. That is, the use of multiple sets of progressively reduced openings allows for the filter of debris from large too small.

Figure 7A:
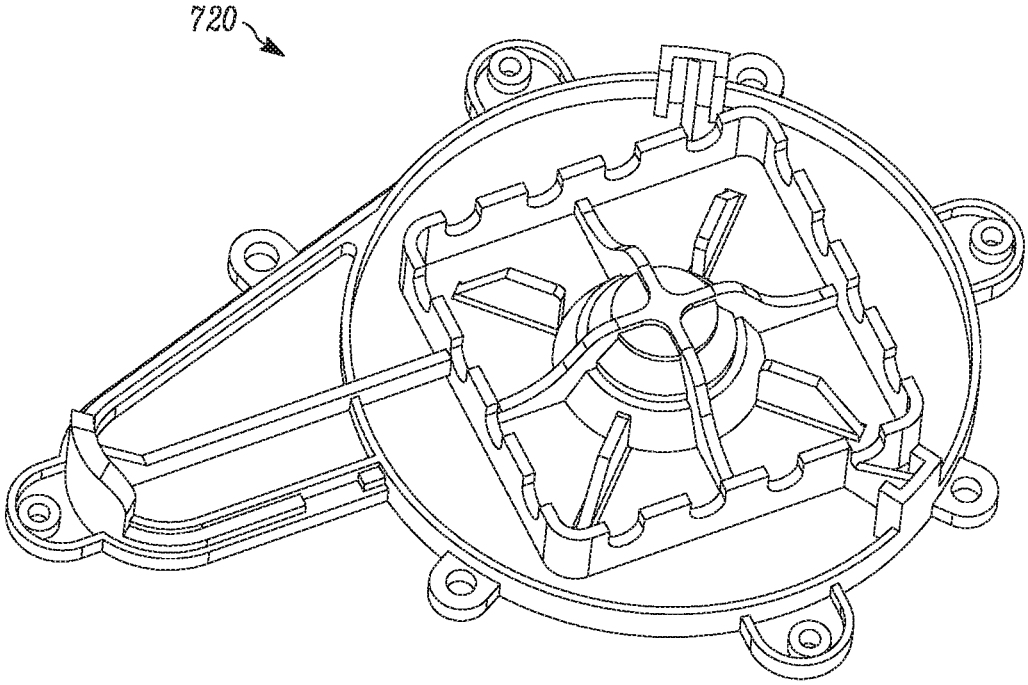
PRIOR ART FIGURE 7A
FIG. 7A is a perspective view of a conventional pump debris filter.
Figure 7B:
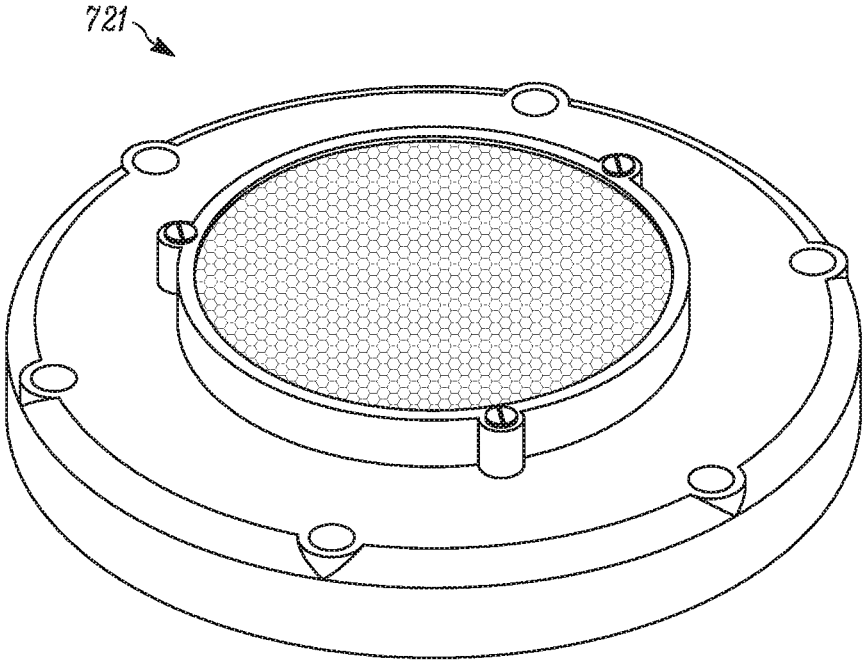
PRIOR ART FIGURE 7B
FIG. 7B is a perspective view of an alternate conventional pump debris filter.

Existing pumps use various openings, obstructions, and screens to filter debris and reduce pump clogging. For example, FIG. 7A shows a plastic filter 720 with teeth, and FIG. 7B shows a screen-type filter 721. Some aspects of the presently described pump use a filter or a similar feature that employs multiple sets of specific sized openings and specific placement to reduce clogging.

The present disclosure also provides a unique housing design that includes an integrated cord wrap system which serves as handles, plus a molded in feature to allow for hanging during storage.

In some embodiments, the top and side discharge outlets can include or be fitted with quick-release fittings. The quick-release fittings can be configured to automatically close-off the unused discharge outlet and allow for quick attachment to a conduit device, such as a garden hose.

In some aspects, the pump may be cordless, and operate with an interchangeable and rechargeable battery pack. In some examples the battery pack can provide a direct current electrical power supply to the pump.

Some examples of the presently disclosed pump provide a user with the ability to convert easily from a top discharge to a side discharge pump. This allows the user to handle a range of residential water pumping applications with a single product.

In some examples, the presently described pump can be made, at least partially, with injection mold tooling.

Some examples of the presently described pump can be used to remove water from pool covers, small swimming pools, hot tubs, flooded window wells, low spots on lawns, flooded basements, flat roofs, stock tanks, rain barrels, and the like.

FIGS. 1A-E present exemplary embodiments of a multi-outlet fluid pump 100. (As described herein, a multi-outlet fluid pump may be referred to as a fluid pumping apparatus, a pumping apparatus, or simply, a "pump.") In some examples the pump 100 has a pump housing 110, and a motorized pump. The motorized pump can be an oil filled pump, or an oil free pump. In some situations, it can be useful to provide pumps that are oil free, for example, in situations where the pump is used in a pool.

Figure 9:
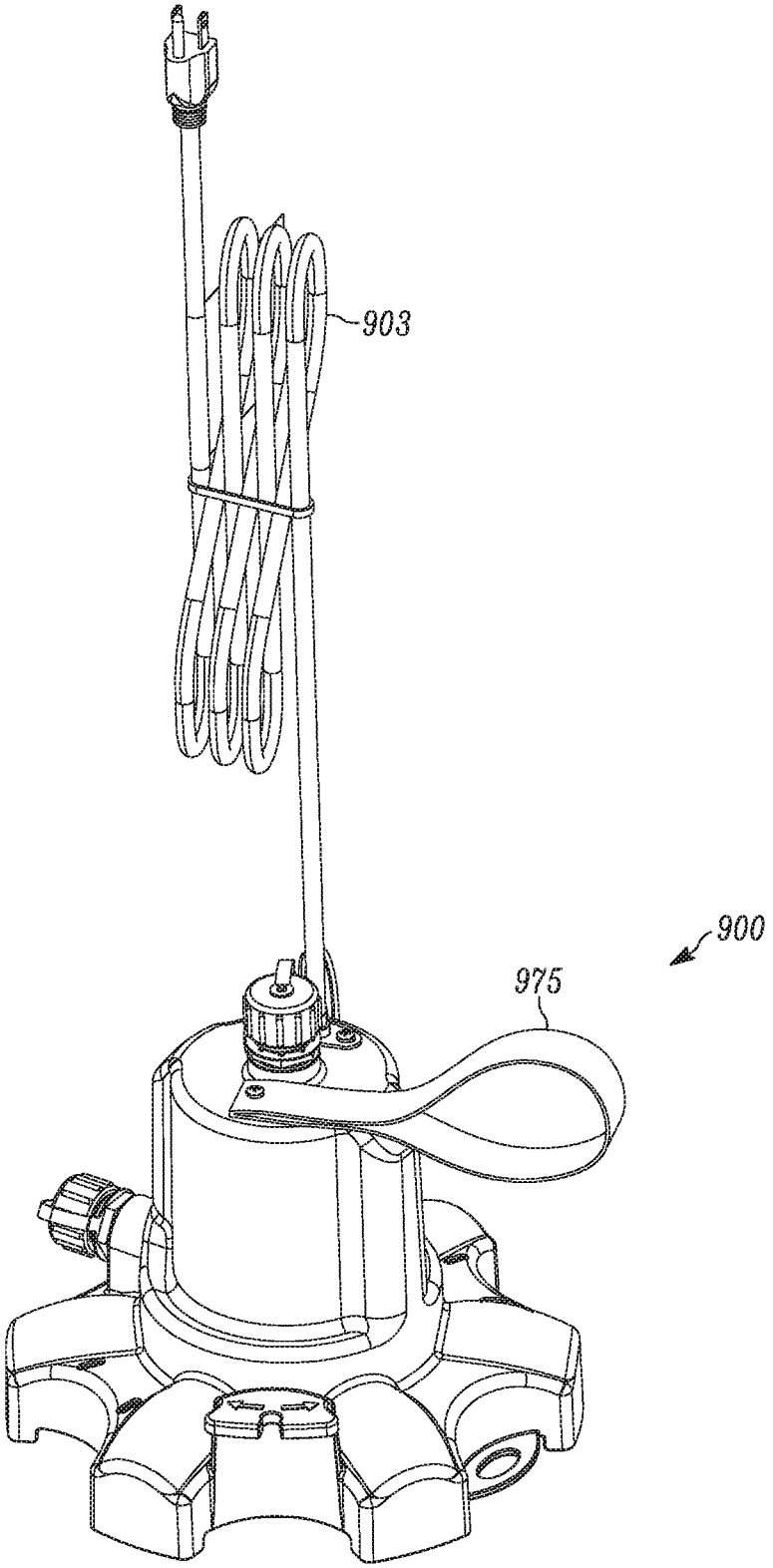
FIG. 9 is a perspective view of an alternate pump with a strap handle and an AC power cord.

An electrical power source supplies electrical power to the motorized pump. The electrical power supply can include an electrical cord for plugging into an AC power supply. FIG. 9 shows an example of a pump 900 with an AC power cord 903 extending from the top of the pump 900. In some embodiments, the pump can be configured to start automatically once plugged in. However, in alternate embodiments, the pump may include actuators or switches that control the turning on/off or other functionality of the pump. (See, e.g., FIGS. 4A and 4B.) For example, the actuators or switches for the pump can include, but are not limited to, on/off switches, tilt switches such as float switches, pressure or pneumatic switches, capacitive sensor switches, etc. In some examples, switches can be used to seal one or more of the discharge outlets, thereby controlling from which outlet the pump discharges fluid.

Figure 4A:
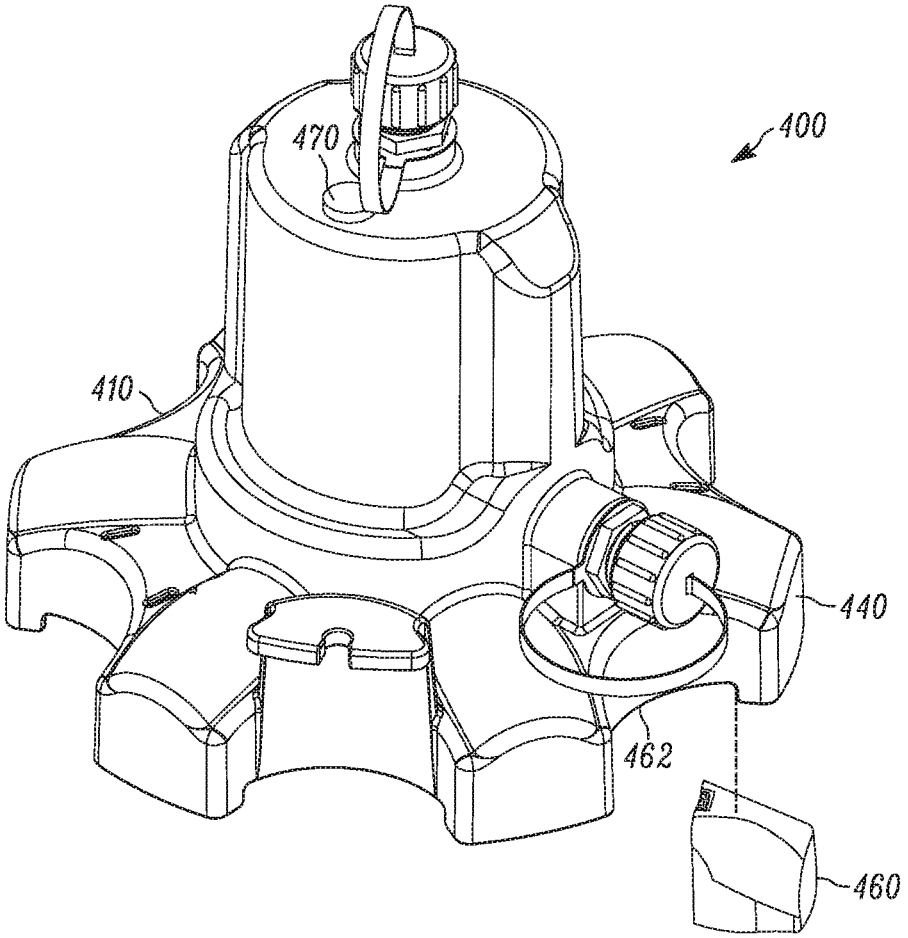
FIGS. 4A and 4B are a perspective views of an example of a pump utilizing a rechargeable and/or replaceable battery as a power source.
Figure 4B:
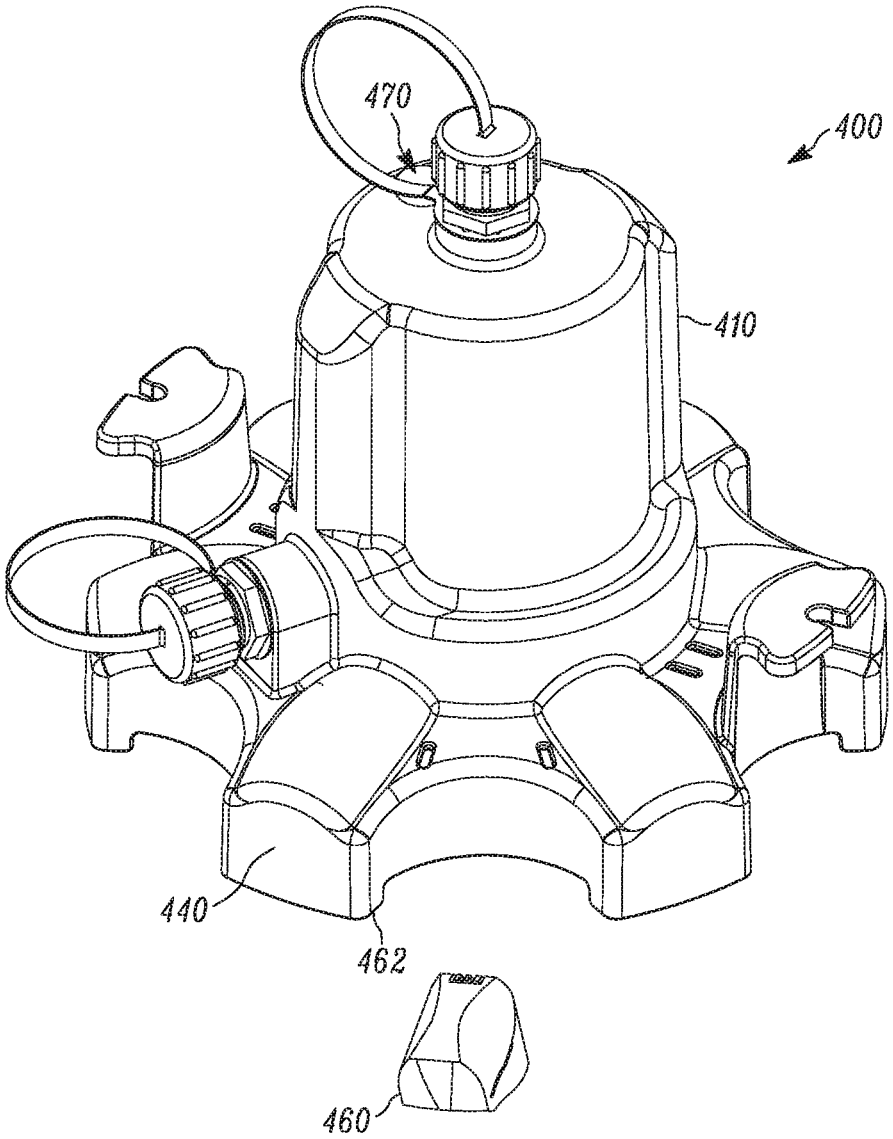
Figure 4C:
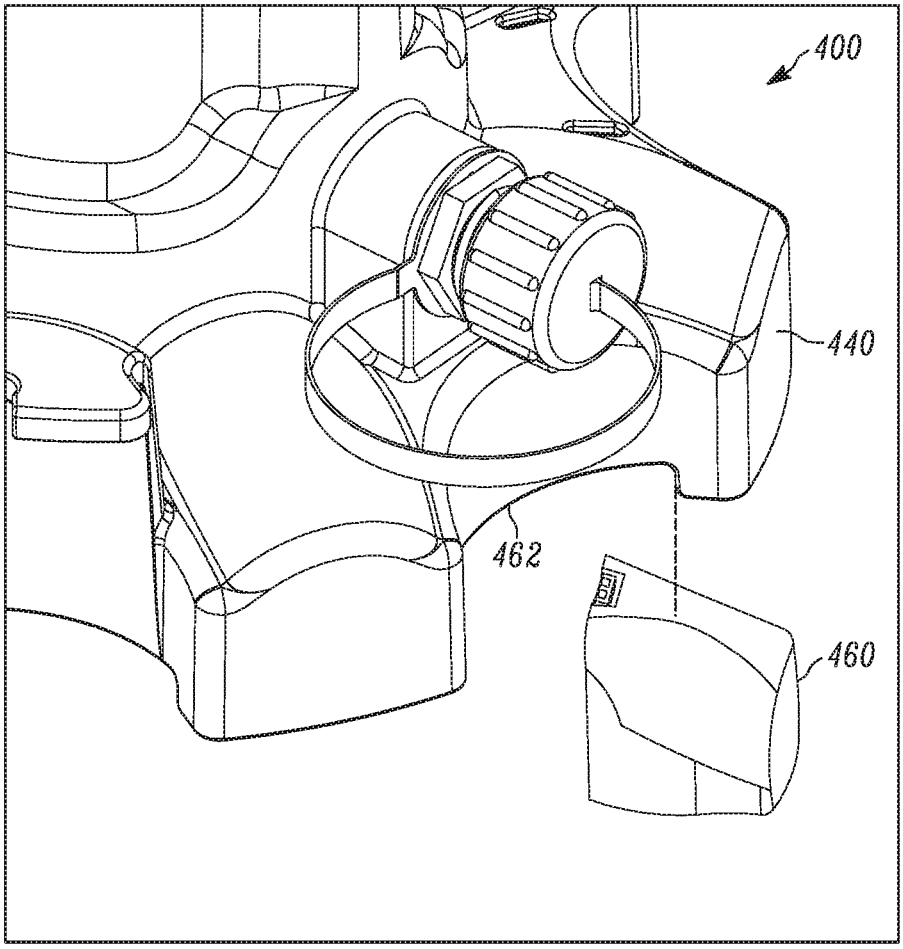
FIGS. 4C and 4D are close up views of the replaceable battery of FIGS. 4A and 4B.
Figure 4D:
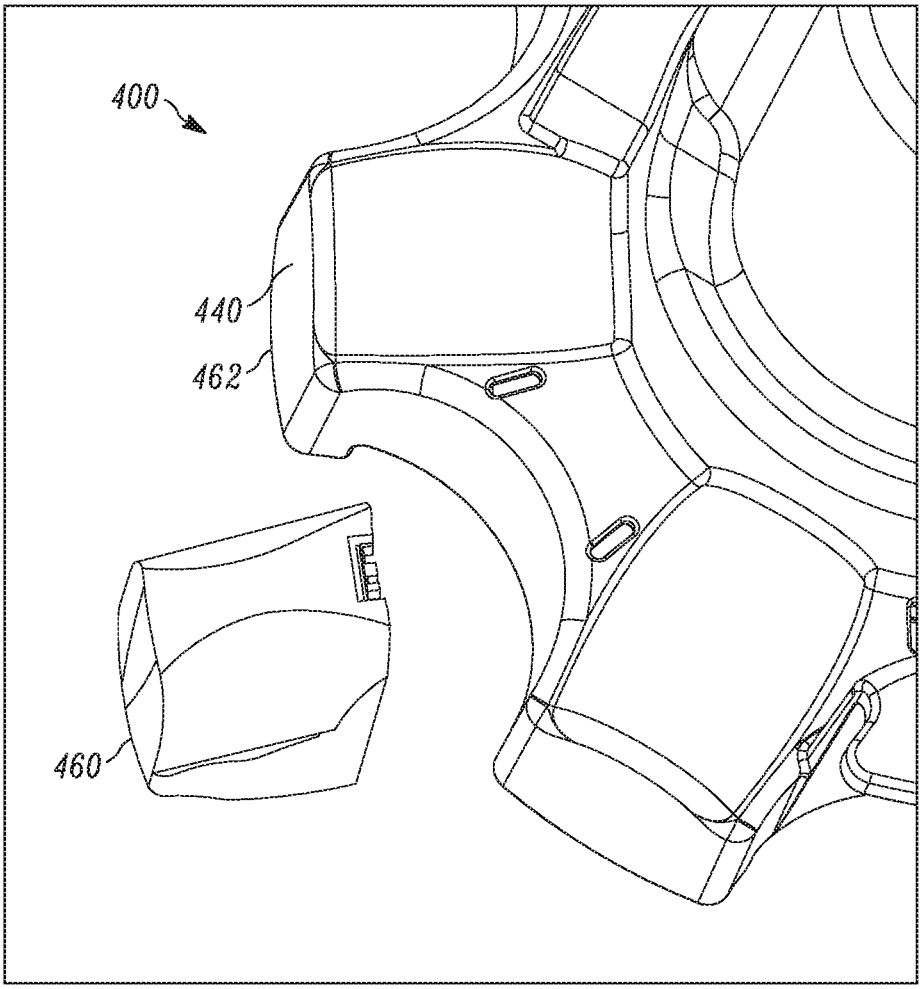

In some embodiments, a battery/battery pack provides a DC power supply as shown in FIGS. 4A-D. FIGS. 4A and 4B shows an example of a pump 400 utilizing a replaceable battery 460 as a power source. FIGS. 4C and 4D are close up views of the replaceable battery 460. The battery 460 attaches to a corresponding power input source 462 on the underside of the housing 410 of the pump 400. In some examples, the battery 460 is of a size to fit within foot member 440 of the pump housing 410. In some forms, the battery can be charged without removing it from the housing by simply plugging in a DC charging cord to a port electrically connected to the battery on one end and to an AC or DC power source on the opposite end. In other forms, the battery pack can be removable and/or rechargeable, such as by way of removing the battery from the pump 400 and connecting it to a charger for charging it from either an AC power source (e.g., a conventional wall outlet) or a DC power source (e.g., car 12V outlet, USB port, etc.).

The battery pack can be removable and/or rechargeable. In some examples, the battery 460 can be recharged via a docking station. In other examples, the battery 460 is rechargeable via a power cord that plugs into the housing. The battery operated pump can be configured to turn on and off via a switch 470 (e.g., a push-button switch) located on the exterior of the pump housing 410 or at the switch plug 903. The switch 470 could include a number of types of activators or switches, including for example, on/off switches (e.g., slide switches, rocker switches, switch nobs, push-button switches, etc.), tilt switches such as float switches, pressure or pneumatic switches, capacitive sensor switches, etc. In still other examples, the battery operated pump 400 could also be set up to automatically start upon detection of the presence of water (e.g., such as by use of a capacitive switch). Additionally and/or alternatively, the pump 400 may include a timer that automatically controls the operation (e.g., the turning on or off) of the pump. The timer can be set so that the pump automatically turns off after being on for a predetermined period of time (e.g., 30 minutes, 1 hour, 2 hours, etc.) so as not to drain more power than necessary. The pump 400 may also be equipped with a sensor to automatically shut the pump off when it determines that it is no longer pumping fluid. The switch 470 (or timer or sensor) is not limited to use on a battery operated pump, and could also be employed on other pumps, including pumps designed to be powered from an AC or DC power source. The switch 470 or timer could also be located at locations away from the pump housing 410. For example, the switch 470 or timer could be located on a power cord that supplies power to the pump 400. Moreover, the power cord could also include a receiver or transceiver (e.g., a radio frequency transceiver) that allows for the remote controllability of the pump 400.

Figure 2:
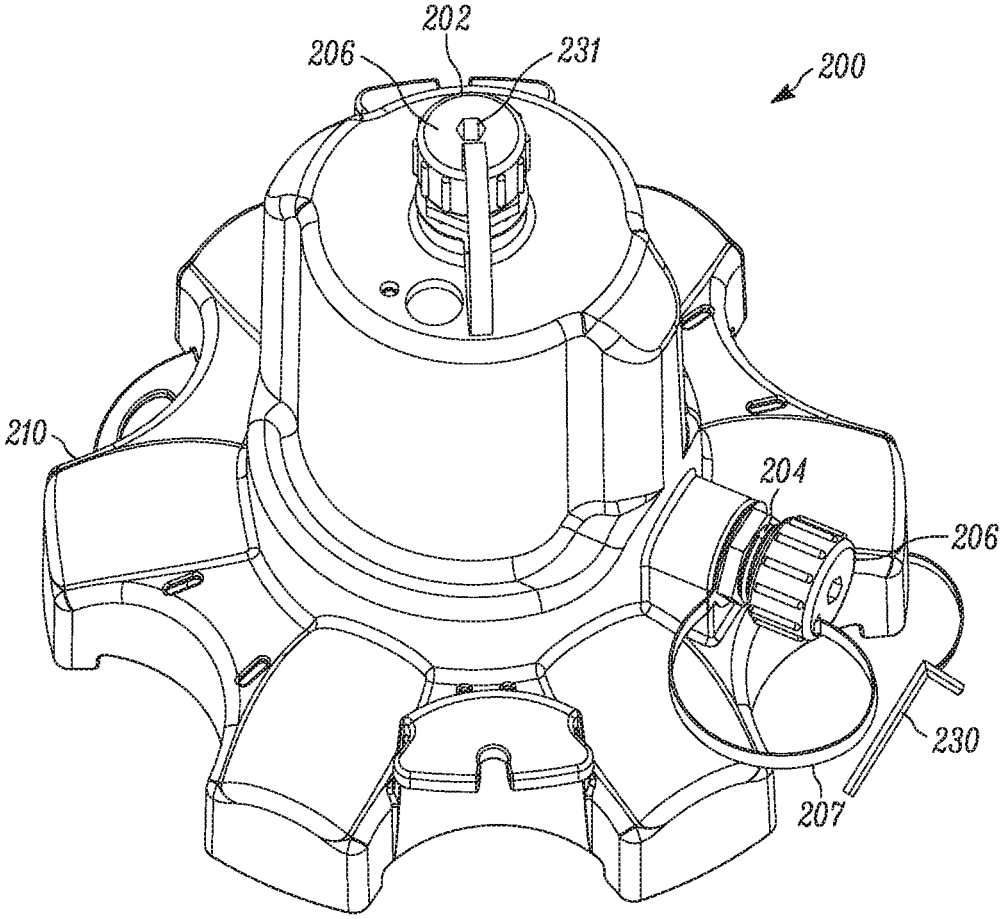
FIG. 2 shows a perspective view of an alternate pump in accordance with other embodiments of the invention illustrating sealant mechanisms such as threaded caps on the discharge outlets to seal the outlets.

Some examples of the pump have a fluid inlet 150 for drawing fluid into the pump housing 110, and a first discharge outlet 102 for discharging fluid out of the pump housing. The first discharge outlet 102 is adapted to attach to a fluid conduit device. In some examples, the first discharge outlet 102 is positioned on a top portion of the pump 100. The pump 100 also has a first sealing mechanism that seals the first discharge outlet 102 to inhibit discharge of fluid from the first discharge outlet 102 when not in use. The first sealing mechanism can include, for example, a threaded cap 206 (which can be tethered to the pump as shown in FIG. 2 via tether 207), or a quick-release fitting 108. The pump 100 also includes a first internal fluid flow path 114 between the fluid inlet and the first discharge outlet.

In some examples, the sealing mechanism may include, or be a part of a system that allows a user to selectively seal one or more of the discharge outlets. For example, the sealing mechanism may include a device built in to one or more of the discharge outlets that is in communication with a switch (e.g., a mechanical or electrical switch) or other controller (e.g., a computer or processor). In this way, a user can select to seal or unseal a discharge port by activating/deactivating the corresponding switch. In some examples, switch or other controller, may be accessible remotely or wirelessly so that the sealing mechanism, as well as other features of the multi-use pump, could be operated at a remote distance. For example, the switches can be configured to communicate with a remote controller device, which can be a radio, infrared, Wi-Fi, Bluetooth, or other type of signal transmitter.

The pump comprises a second discharge outlet 104 for discharging fluid out of the pump housing. In some examples, the second discharge outlet 104 is positioned on the side of the pump 100. The second discharge outlet is adapted to attach to a fluid conduit device.

A second sealing mechanism seals the second discharge outlet to inhibit discharge of fluid from the second discharge outlet when not in use. The second sealing mechanism, can also include a threaded cap 106 (which can be tethered to the pump) or a quick-release fitting 108. The pump 100 has a second internal fluid flow path 116 between the fluid inlet 150 and the second discharge outlet 104.

Referring to FIG. 2, a tool 230 (see FIG. 2) may be provided for use in securing or releasing the sealing mechanism or mechanisms as desired. For example, in one form, the pump 100 may be provided with only one sealing mechanism that is simply moved from the first discharge outlet 202 to the second discharge outlet 204 and vice versa, as needed to operate the pump in the desired manner (either side discharge or top discharge). In some examples, the sealing mechanism includes a socket 231 or other component that is designed to mate with the tool 230 to facilitate installation of the sealing mechanism. For example, where the tool 230 is an Allen wrench, the sealing mechanism may include a hexagonal shaped socket 231 designed to receive an end of the Allen wrench, so that the Allen wrench can readily tighten/loosen the sealing mechanism on or off of the outlet. In some forms, the tool 230, such as a wrench (e.g., hex key, Allen wrench, etc.), may be tethered to the sealing mechanism and used to tighten or release the sealing mechanism to the desired discharge outlet. In other forms, the pump housing 210 may define a socket or sleeve for holding such a tool.

Referring again to FIGS. 1A-E, the pump housing 110 surrounds the motorized pump, the first internal fluid flow path and the second internal fluid flow path. In some instances, the pump housing 110 may even define part of one or both of the internal fluid flow paths. In operation, the pump 100 directs fluid from the fluid inlet 150 to the first discharge 102 outlet when the second discharge outlet 104 is sealed, and directs fluid from the fluid inlet 150 to the second discharge outlet 104 when the first discharge outlet 102 is sealed.

The pump 100 may include an electrical power outlet opening 103, which can be configured to receive or otherwise mate with a power cord to provide power to the pump 100. In some examples, the opening 103 is configured to provide a water-proof connection to a water-proof power cord.

Some examples of the pump 100 include a cord-wrap mechanism 112 that facilitates winding of an electrical cord around the pump housing. In one example, the cord-wrap mechanism 112 comprises a plurality of protuberances extending from the pump housing 110. One or more of the protuberances can comprise, or operate as a handle to facilitate handling of the pump. In some forms, the handle and cord-wrap mechanism 112 are integrated into a common structure so that the protuberance forms both a handle and a portion of a cord-wrap mechanism. In still other examples, the pump 100 may have a separate handle integrated into and/or attached to the pump 100. For example, FIG. 9 shows a version of a pump 900 that includes a strap handle 975 attached to the top of the pump to help a user grab, carry, or otherwise transport the pump. The strap 975 may be made of a cloth material, leather, rubber, or other durable material. The strap 975 can form a loop to facilitate grasping with a hand or being thrown over a user's shoulder, for example. The strap 975 may be permanently affixed to the pump 900, or it may be removably attached, allowing the user to dispose of the strap if it is not desired, or if it may get in the way of a particular application. In other examples, the pump 100/900 may include other aspects that can be used as a handle, including a bar, a knob, or a recessed groove. The handle can be placed on the top, as shown in FIG. 9, or in other locations such as the side, bottom, or another location of the pump 100 that facilitates carrying and handling of the pump 100.

Some examples of the pump 100 also include a hanging apparatus 118 (see FIGS. 1C-E), or a hook that supports vertical hanging of the pumping apparatus. The hanging apparatus 118 is positioned so that the vertically hanging pumping apparatus is arranged to facilitate fluid drainage out of at least one of the discharge outlets. For example, the hanging apparatus 118 can be arranged so that, when hanging, fluid within the pump 100 drains easily out of the side discharge outlet 104. In some forms, the hanging apparatus is integrated with at least one of the handle and cord wrap mechanism to further conserve space and make more efficient use of the structural design of the pump.

In some examples, the pump 100 comprising a filter system that filters debris from the motorized pump. The filter system can include a plurality of concentric filter levels, including, for example, filter rings (122, 124, 126), and/or legs 128, each concentric filter level having a plurality of filter openings (123, 125, 127, 129), wherein the filter openings (e.g., 123) of an outer concentric filter ring (e.g., 122) are larger than the filter openings (e.g., 125, 127) of any inner concentric filter ring (124, 126) so that at least some smaller debris that can pass through an outer concentric filter ring is filtered by an inner concentric filter ring.

Figure 1C:
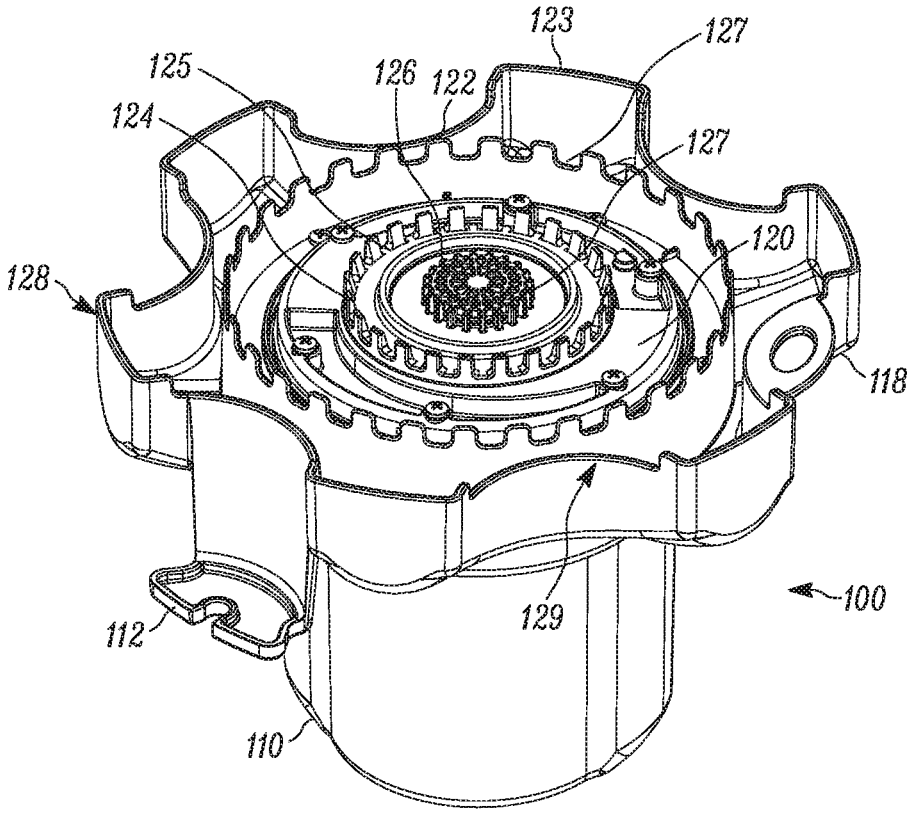
FIG. 1C is an alternate perspective view of the pump of FIG. 1A taken from below and with the pump inverted illustrating the outer housing for a fluid pumping device and the bottom portion of the housing employing a plurality of filter rings each with filter openings of varying size. The filter rings can be a part of the pump housing and a filter.
Figure 1D:
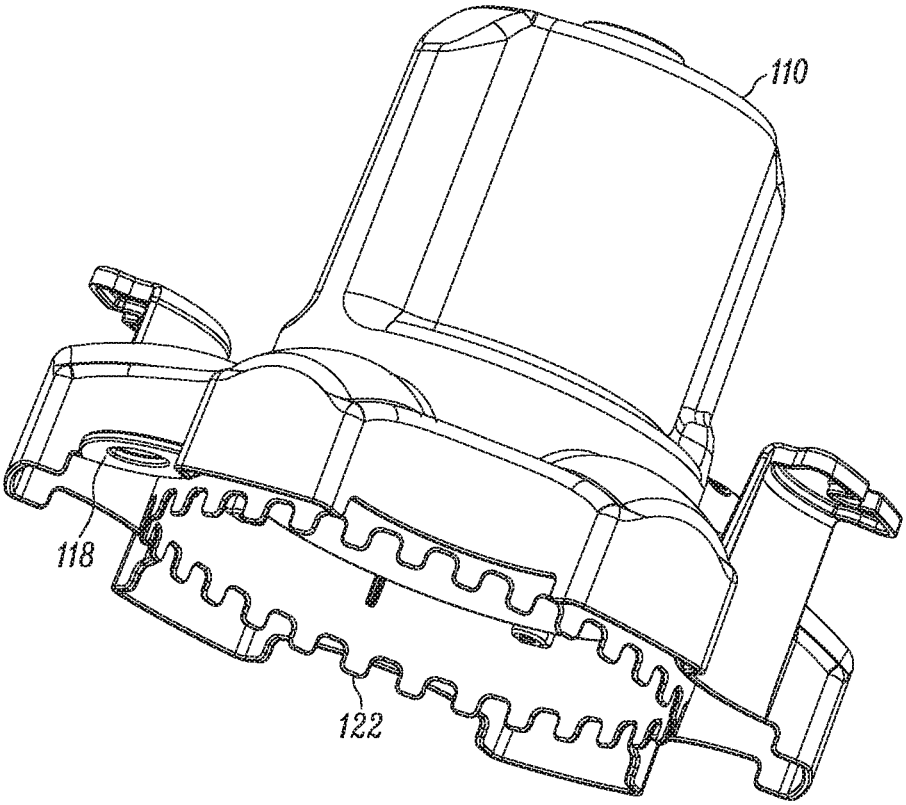
FIGS. 1D-E show perspective views from below and above, respectively, of just the housing of the pump of FIGS. 1A-C illustrating various features of the pump housing.
Figure 1E:
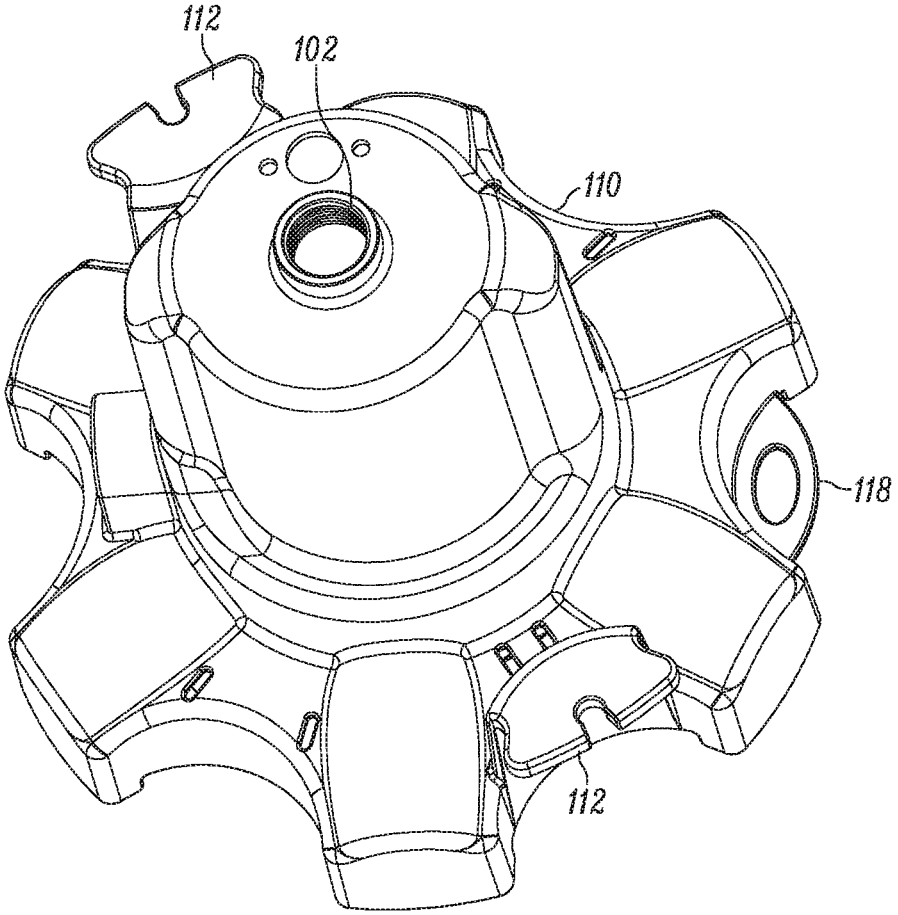

In some aspects, at least one filter ring (122, 128) is a component of the pump housing 110, as shown in FIGS. 1C and 1D. Additionally and/or alternatively, the filter system comprises a filter device 120, wherein at least one filter ring (124, 126) is a component of the filter device 120.

Figure 3:
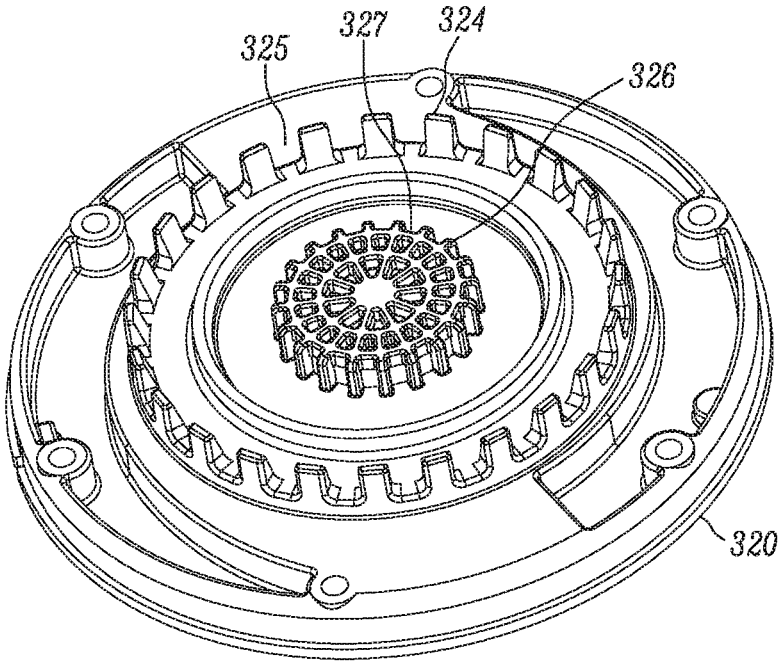
FIG. 3 shows a perspective view of the central ring filter assembly of the pump of FIGS. 1A-C illustrating various features of same.

FIG. 3 shows an example of a filter device 320 for a fluid pump. In some examples, the filter 320 includes a plurality of concentric filter rings 324, 326. Each concentric ring has a plurality of filter openings 325, 327. The filter openings 325 of an outer concentric filter ring 234 are larger than the filter openings 327 any inner concentric filter ring 326 so that at least some smaller debris that can pass through an outer concentric filter ring is filtered by an inner concentric filter ring.

Other embodiments further include a housing that is configured with a first mating structure that allows accessories to be attached or removed from the pump. For example, in one form the pump housing defines a socket within which the above mentioned tethered tool may be stored for tightening and loosening the sealing mechanism. In other forms, housing attachments or accessories, such as leg extenders or handles may be attached to either stabilize the pump or allow it to be dropped into sumps or other recessed areas more easily. In some forms, some of the above mentioned features may also be attached to the pump with such a mating structure in order to allow the pump to be customized as desired by the user. For example, the above-mentioned cord wrap structures, handles and/or hooks could connect to the pump housing using a mating structure, such as a friction fit tongue and groove configuration. In this way, they could be moved about the pump housing to be placed in an orientation desired by the user or replaced with alternate accessories (e.g., different shaped hook receptacles, longer legs or foot members, etc.).

In some examples, the pump and/or the pump housing can include foot members 140 that support the stability of the pump. In some aspects, the foot members 140 can be adapted so that accessories such as the above-mentioned leg extensions can be connected, thereby expanding the diameter of the base of the pump 100 to provide even further stability.

Figure 8:
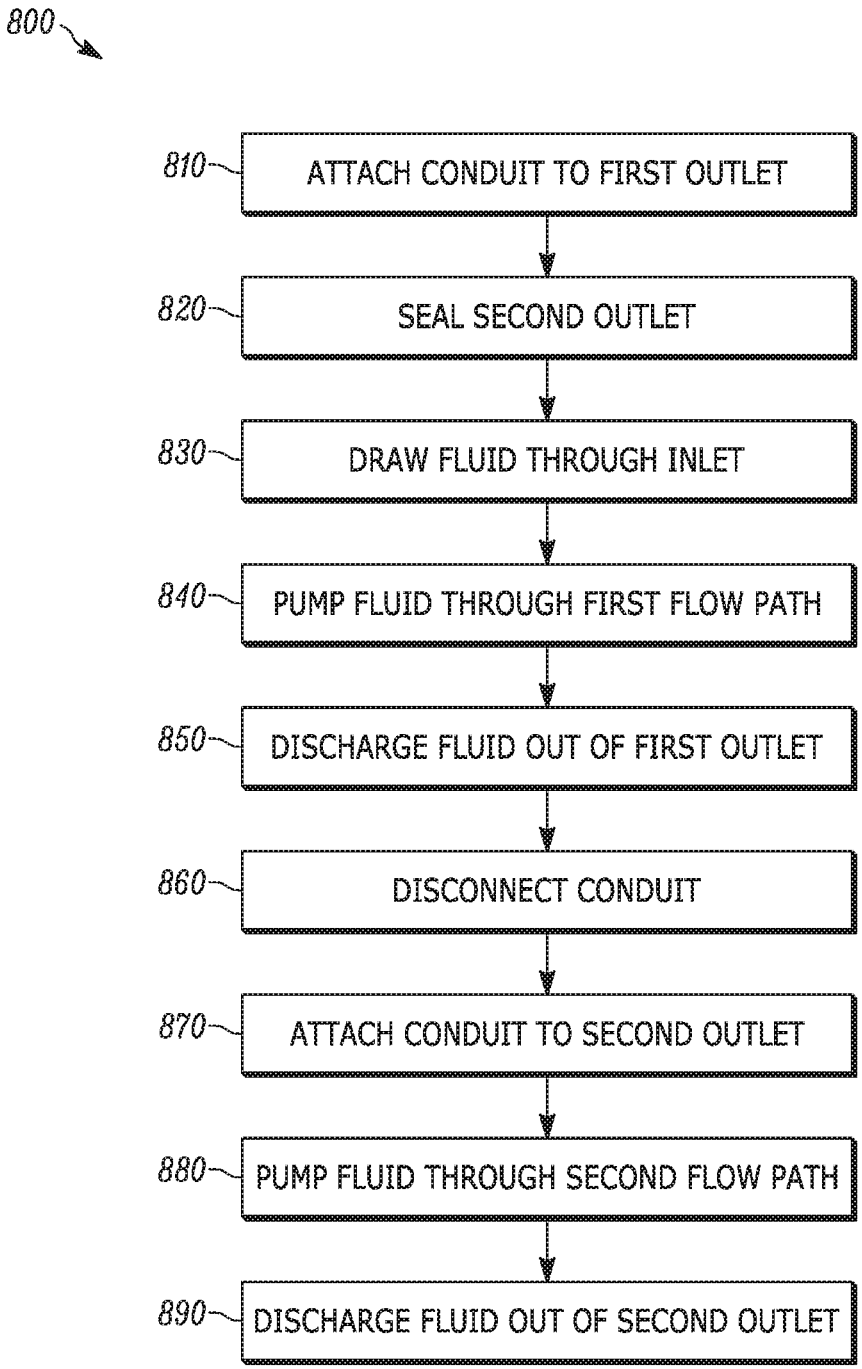
FIG. 8 is a flow diagram of an example method for pumping fluid from a pumping apparatus in accordance with aspects described herein.

The present disclosure also relates to methods of pumping fluid. In particular, the present disclosure describes examples of methods and techniques from pumping fluid in from multiple outlets in a pumping apparatus. FIG. 8 provides a flow diagram of an example of one such method 800.

The method 800 involves pumping fluid from multiple outlets in a fluid pumping apparatus, which can be any of the pumping apparatuses described herein. In some examples, the pumping apparatus has a pump and a pump housing, and two discharge outlets. Each of the discharge outlets may have a sealing mechanism that serves to seal the outlet when not in use, but to allow free flow of fluid out of the outlet when in use. In some examples, the two outlets can be placed on opposite sides of the pumping apparatus. In other examples, the outlets are placed on different sides of the apparatus so as to pump in two different (e.g., perpendicular) directions. For example, one outlet may be on the top of a pumping apparatus, and the other can be on the side of the apparatus. The pump has at least two internal flow paths in the housing that connects an inlet to each of the discharge outlets.

The method 800 can include attaching 810 a fluid conduit to a first discharge outlet. This attaching can serve to unseal the first sealing mechanism and establish a fluid connection with the conduit. In some aspects, the step of unsealing may occur prior to the attaching of the conduit. For example, unsealing the outlet may first involve removing a cap from the discharge outlet.

Using a sealing mechanism, the second discharge outlet is also sealed 820 to inhibit, obstruct and/or prevent fluid from being discharged from the second discharge outlet. Sealing can include placing a threaded cap over the second discharge outlet, or using an internal sealing mechanism (e.g., similar to a seal in a quick-release mechanism) to maintain a seal of the discharge outlet. In some examples, step 820 may not require an active step. For example, when the outlet defaults to a sealed position, step 820 may simply include maintaining the second outlet in a sealed position. In some examples, the sealing mechanism can be built into the discharge outlet and activated by way of a switch (e.g., a mechanical or electrical switch), that allows the user to select which discharge outlet to use without having to actively seal or close that specific outlet.

Next, the pump is operated 830 to draw fluid into the pump housing through the inlet. The fluid is then directed 840 from the fluid inlet, through a first internal fluid flow path in the housing, and toward the first discharge outlet. Because the second discharge outlet is sealed, fluid will not be directed toward that outlet. Fluid is then discharged 850 from the first outlet, through the conduit, as desired by the user.

Because the method 800 contemplates using multi-outlet pumps, the method 800 may further comprise additional steps that allow for the pumping of fluid out of the second port. In this manner, the method 800 may include disconnecting 860 the conduit from the first outlet, and subsequently re-sealing the first outlet. In some examples, a significant amount of time may elapse between step 850 and step 860, such that the two steps are each performed as part of separate pumping tasks. In some examples, the disconnecting 860 of the conduit may serve to automatically seal the first outlet, for example, by using a quick-connect sealing mechanism to automatically seal the first discharge outlet so that the pump will not discharge fluid from that port.

A conduit is then attached 870 to the second discharge outlet, thereby establishing a fluid connection between the second discharge outlet and the inlet. The attaching 870 of the conduit may serve to unseal the second discharge outlet itself, but in some examples, a separate step of unsealing may be necessary. For example, it may be necessary to remove a cap that was previously sealing the second discharge outlet.

In some examples, the same conduit that was previously attached to the first discharge outlet (e.g., in step 810) may be used to connect to the second discharge outlet in step 870. However, in other examples, different conduits may be used. Further, in some examples, each discharge outlet may be configured to use different types of outlets, such as outlets having different mating parts or conduit diameters.

Fluid is then pumped 880 into the inlet and through the second flow path toward the second discharge outlet. The fluid is then discharged out of the second outlet 890, through the conduit. In this way, the pump can be used to discharge fluid from different outlets. In some examples, wherein the fluid discharged from the second discharge outlet (e.g., in step 890) is discharged in a direction perpendicular to the direction of fluid discharged from the first port (e.g., in step 850). In other examples, for example, where the discharge ports are arranged on opposite ends, the discharge directions can be parallel to one another.

It should be noted that the example described above involves attaching a conduit to the discharge outlets prior to fluid being discharged therethrough. However, not all embodiments will require the connection of a conduit, as fluid may simply be projected away from the outlet. In this manner, the discharge outlet may utilize a switch, lever, or other technique to maintain the outlet sealing mechanism in an unsealed position.

Moreover, some embodiments can determine which of the multiple outlets to discharge fluid based on other techniques that are not based on which outlet has a conduit attached. For example, it may be possible in some embodiments to have conduits connected to all outlets, without rendering those discharge outlets functional or active. For example, the pump may include a selector mechanism that, in addition to the caps and connection mechanisms described above, could further include a switch, a lever, a toggle, a valve, an actuator, or another selector device that determines (or allows a user to determine) which of the discharge outlets will discharge fluid during operation of the pump, even if all outlets are attached to a conduit. For example, the selection mechanism could include a valve that opens and/or closes one or more of the internal flow paths of the pump that directs fluid from the inlet to each of the various discharge outlets.

In this way, methods for controlling a multi-flow pump may include providing a pump having an inlet, and at least a first outlet, a second outlet. The provided multi-flow pump would also have a mechanism for selecting which of the first outlet and second outlet fluid will through. The method further includes moving the mechanism between a first position for allowing fluid to flow through the first outlet and a second position for allowing fluid to flow through the second position. For example, the method may include utilizing a first outlet obstruction and a second outlet obstruction in the pump. The obstructions may be placed in the internal fluid flow paths of within the pump housing. The method may involve moving the mechanism between the first position and second position comprises, respectively, such that the second outlet obstruction engages with the second outlet to obstruct the second outlet and prevent fluid from flowing through the second outlet when the mechanism is in the first position. Further, the method can include moving the first outlet obstruction into engagement with the first outlet to obstruct the first outlet and prevent fluid from flowing through the first outlet when the mechanism is in the second position.

The moving of the mechanism can be performed manually by a user, such as by sliding a lever or pressing toggle mechanism, or the moving could be performed automatically and/or electronically, such as by a controller or computer operated device. For example, the controller can be configured to automatically move a lever, valve, actuator, obstruction device, or the like in response to receiving a signal or command. Additionally and/or alternatively, the controller may effect movement of the mechanism in response to making a determination to change the discharge flow outlets. Such a determination could be based on a variety of factors or combinations of factors, such as the detection (using sensors) of the amount of flow into and/or out of the pump, a detection of the amount of time (using a timer) that monitors how long the pump is operating, and/or algorithms that monitor pumping features such as pumping speed, power, efficiency, flow rate, flow volume, etc.

Additionally and/or alternatively, the pump could be configured so that some or all of the outlets are capable of discharging fluid even if there is no conduit attached thereto. In some situations, the pump can be configured so that more than one of the pump outlets discharge fluid simultaneously, regardless of whether or not a conduit is attached thereto.

The present figures show pumps with dual outlets for purposes of simplicity of description. It should be understood that the described technology could include three or more outlets, depending on the size, shape, and construction of the pump. In any case, the pump will have the ability to pump from one outlet, or a selection of multiple outlets, among all of the outlets on the pump itself. For example, pumps may include three, four, or even five discharge outlets, and can be configured so that only one of the outlet discharges fluid during operation, so that some of the outlets discharge fluid during operation, or so that all of the outlets are discharging fluid during operation.

Some embodiments may incorporate one or more features of the Wayne Water Systems ISP50 pump, which is described in U.S. patent application Ser. No. 10/233,832, filed Aug. 29, 2002, now U.S. Pat. No. 6,676,382, issued Jan. 13, 2004 and their capacitive water sensor application Ser. No. 12/944,883 filed Nov. 12, 2010, now abandoned, which application is hereby incorporated by reference in its entirety. Some embodiments may also employ a capacitive water sensor to control operation of the pump, as well as other features described in U.S. patent application Ser. No. 12/944,883, filed Nov. 12, 2010, now abandoned, which is hereby incorporated by reference in its entirety. Other embodiments may employ various features of the pump parts shown in the detailed drawings and descriptions associated with design patent application No. 29/548,937, which is also hereby incorporated by reference in its entirety.

It should be understood that the embodiments discussed herein are simply meant as representative examples of how the concepts disclosed herein may be utilized and that other system/method/apparatus are contemplated beyond those few examples. In addition, it should also be understood that features of one embodiment may be combined with features of other embodiments to provide yet other embodiments as desired.

What is claimed is:

1. A fluid pumping apparatus comprising:

a pump housing having an upper portion and a side portion that is perpendicular to the upper portion, the side portion forming an axial wall about a vertical longitudinal axis and the upper portion enclosing an end of the side portion to form a pump housing cavity;

a motorized pump disposed at least partially within the pump housing cavity;

a fluid inlet for drawing a fluid into the pump housing;

a top discharge outlet positioned in the upper portion of the pump housing for discharging the fluid out of the upper portion of the pump housing in a direction parallel to the vertical longitudinal axis;

a top sealing mechanism configured to seal the top discharge outlet to inhibit discharge of the fluid from the top discharge outlet when sealed;

a first internal fluid flow path between the fluid inlet and the top discharge outlet;

a side discharge outlet positioned in the side portion of the pump housing for discharging the fluid out of the side portion of the pump housing in a direction perpendicular to the vertical longitudinal axis;

a side sealing mechanism configured to seal the side discharge outlet to inhibit discharge of the fluid from the side discharge outlet when sealed;

a second internal fluid flow path between the fluid inlet and the side discharge outlet;

wherein the pump housing surrounds the motorized pump, the first internal fluid flow path and the second internal fluid flow path, and wherein the motorized pump, in operation, directs the fluid from the fluid inlet to the top discharge outlet when the side discharge outlet is sealed, and directs the fluid from the fluid inlet to the side discharge outlet when the top discharge outlet is sealed.

2. The pumping device of claim 1, wherein the fluid discharged from the top discharge outlet is discharged perpendicular to the fluid discharged from the side discharge outlet.

3. The pumping apparatus of claim 1, wherein at least one of the top discharge outlet and the side discharge outlet comprise a quick release fitting configured to establish a fluid connection with a fluid conduit device and to automatically seal the at least one of the top discharge outlet and the side discharge outlet when no fluid conduit device is attached thereto.

4. The pumping apparatus of claim 1, further comprising a cord-wrap mechanism to facilitate winding of an electrical cord around the pump housing, the cord-wrap mechanism comprising a plurality of protuberances extending from the pump housing, wherein at least one protuberance comprises a handle to facilitate handling of the pumping apparatus.

5. The pumping apparatus of claim 1, further comprising a filter system configured to filter debris drawn in from the fluid inlet from the motorized pump, wherein the filter system comprises a plurality of concentric filter levels, including an outer concentric filter level and an inner concentric filter level, each concentric filter level includes a plurality of filter openings, wherein the plurality of filter openings of the outer concentric filter level is larger than the plurality of filter openings of any inner concentric filter level so that at least some smaller debris that can pass through the outer concentric filter level is filtered by the inner concentric filter level.

6. The pumping apparatus of claim 1, wherein the first internal fluid flow path and the second internal fluid flow path pass the fluid over a motor of the motorized pump during operation thereof.

7. The pumping apparatus of claim 1, wherein the fluid inlet is positioned proximate a bottom of the pump housing and is configured to draw in fluid from below the housing cavity.

8. A fluid pumping apparatus comprising:

a pump housing having a substantially cylindrical shape with a vertical longitudinal axis;

a motorized pump disposed inside the pump housing;

a fluid inlet for drawing a fluid into the pump housing;

a first discharge outlet for discharging the fluid out of the pump housing in a direction parallel with the vertical longitudinal axis, the first discharge outlet adapted to attach to a first fluid conduit device;

a first sealing mechanism that seals the first discharge outlet to inhibit discharge of the fluid from the first discharge outlet when not in use;

a first internal fluid flow path between the fluid inlet and the first discharge outlet;

a second discharge outlet for discharging the fluid out of the pump housing in a direction perpendicular to the vertical longitudinal axis, the second discharge outlet adapted to attach to a second fluid conduit device;

a second sealing mechanism that seals the second discharge outlet to inhibit a discharge of the fluid from the second discharge outlet when not in use; and a second internal fluid flow path between the fluid inlet and the second discharge outlet;

wherein the pump housing surrounds the motorized pump, the first internal fluid flow path and the second internal fluid flow path, and wherein the motorized pump, in operation, directs the fluid from the fluid inlet to the first discharge outlet when the second discharge outlet is sealed, and directs the fluid from the fluid inlet to the second discharge outlet when the first discharge outlet is sealed.

9. The pumping apparatus of claim 8, wherein at least one of the first and second sealing mechanism comprise a quick release fitting, the quick release fitting configured to establish a fluid connection with the first fluid conduit device or with the second fluid conduit device and to automatically seal at least one of the first and second discharge outlet when no fluid conduit device is attached thereto, wherein the first conduit device and the second fluid conduit device being the same conduit device.

10. The pumping apparatus of claim 8, wherein at least one of the first and second sealing mechanisms comprise a threaded cap that installs over respective discharge outlet.

11. The pumping apparatus of claim 8, wherein the first sealing mechanism and the second sealing mechanism being configured to be attached and/or removed via a tool that is tethered to the pumping apparatus.

12. The pumping apparatus of claim 8, wherein the pump housing comprises a cord-wrap mechanism to facilitate winding of an electrical cord around the pump housing.

13. The pumping apparatus of claim 12, wherein the cord-wrap mechanism comprises a plurality of protuberances extending from the pump housing, and wherein at least one protuberance comprises a handle to facilitate handling of the pumping apparatus.

14. The pumping apparatus of claim 8, wherein the housing further comprises a hanging apparatus that supports vertical hanging of the pumping apparatus, the hanging apparatus positioned so that the vertically hanging pumping apparatus is arranged to facilitate fluid drainage.

15. The pumping apparatus of claim 8, further comprising a filter system configured to filter debris drawn in from the fluid inlet.

16. The pumping apparatus of claim 15, wherein the filter system comprises a plurality of concentric filter ring levels, including an outer concentric filter ring level and an inner concentric filter ring level, each concentric ring level includes a plurality of filter openings, wherein the plurality of filter openings of the outer concentric filter ring level is larger than the plurality of filter openings of any inner concentric filter ring level so that at least some smaller debris that can pass through the outer concentric filter ring level is filtered by the inner concentric filter ring level.

17. The pumping apparatus of claim 16, wherein at least one filter ring level is a component of the pump housing.

18. The pumping apparatus of claim 15, wherein the filter system comprises a filter device, wherein at least one filter ring level is a component of the filter device.

19. The pumping apparatus of claim 1, wherein the motorized pump is powered by an electrical power supply that comprises a battery that is removably attachable to the pumping apparatus.

20. The fluid pumping apparatus of claim 19, wherein the battery is configured to fit within a foot member of the pump housing.

* * * * *